United States Patent [19]

Uemura et al.

[11] 4,177,132

[45] Dec. 4, 1979

[54] PROCESS FOR THE CONTINUOUS PRODUCTION OF PETROLEUM-DERIVED PITCH

[75] Inventors: Seiichi Uemura; Syunichi Yamamoto, both of Kawasaki; Takao Hirose, Kamakura; Hiroaki Takashima, Kawasaki; Osamu Kato, Yokohama; Minoru Nagi, Kawasaki, all of Japan

[73] Assignee: Nippon Oil Company, Ltd., Tokyo, Japan

[21] Appl. No.: 849,701

[22] Filed: Nov. 8, 1977

[30] Foreign Application Priority Data

Nov. 12, 1976 [JP] Japan ..... 51-135236

[51] Int. Cl.[2] ..... C10C 3/00

[52] U.S. Cl. ..... 208/22; 208/6; 208/40

[58] Field of Search ..... 208/6, 40, 22

[56] References Cited

U.S. PATENT DOCUMENTS

| | | | |
|---|---|---|---|
| 2,752,290 | 6/1956 | Beattie | 208/40 |
| 3,794,579 | 2/1974 | Enomoto et al. | 208/40 |
| 4,080,283 | 3/1978 | Noguchi et al. | 208/40 |
| 4,086,156 | 4/1978 | Dickakian | 208/41 |

*Primary Examiner*—Veronica O'Keefe

*Attorney, Agent, or Firm*—Bucknam and Archer

[57] ABSTRACT

A process for the continuous production of petroleum-derived pitch comprising the steps of subjecting a heavy fraction boiling at not lower than 150° C., the heavy fraction being obtained by the steam cracking of petroleum-derived hydrocarbons, to a specified first-step heat treatment, subjecting the first-step treated fraction to a specified second-step heat treatment and then removing the light fraction from the second-step treated fraction thereby to obtain the petroleum-derived pitch.

3 Claims, 5 Drawing Figures

PROCESS FOR THE CONTINUOUS PRODUCTION OF PETROLEUM-DERIVED PITCH

This invention relates to a process for the continuous production of petroleum-derived pitch.

Heretofore, olefins such as ethylene and propylene have been produced usually by steam cracking or thermocracking petroleum-derived hydrocarbons such as naphtha and kerosene; in this case, heavy residual oils have also been produced as by-products. In addition, with the recent enlargement of apparatus for producing ethylene and the recent use of petroleum-derived heavy hydrocarbons as starting material, the amount of heavy residual oils produced as by-products has increased. The heavy residual oils have now partly been used as material for carbon black with the greater part thereof being used as fuel. Since the heavy residual oils have a high aromatic content and will produce a large quantity of gases when burnt, they will raise a trouble as to the accumulation of carbon flower around the fuel inlet nozzle of a combustion furnace. It is thus very inconvenient to use them as fuel. Therefore, it has recently been a problem to be urgently solved in the technical field concerned to convert such heavy residual oils to products having fairly enhanced values. On the other hand, various attempts have been made to find a process for producing, for example, pitch as a binder for carbon electrodes and the like from the heavy residual oils.

At the present, pitch of coal tar origin is mainly used as a binder for carbon electrodes and the like. However, such coal-tar pitch as required to have a high content of fixed carbon (Conradson carbon) in view of caking at the time of sintering and to have a softening point of 60°-100° C. in view of operation. If the heavy residual oils produced as by-products by steam cracking as previously mentioned be heat treated in attempts to obtain pitch having a high content of fixed carbon, the resulting pitch will have an elevated softening point and will be difficult to use as a binder. For example, if such heavy residual oils be so heat treated as to obtain pitch having a fixed carbon content of at least 50%, the resulting pitch will necessarily have an elevated softening point of about 150° C. and will therefore be not a desired pitch.

Japanese Patent Gazette No. 2417/1971 discloses that a heavy fraction is heat treated at 250°-550° C. to obtain pitch having a boiling point of at least about 400° C. on one hand and a remarkably high softening point of 230°-250° C. on the other hand.

In addition, Japanese Patent Application Laying-Open Gazette No. 73405/1973 discloses that firstly a heavy fraction is treated at a pressure of 20-200 $Kg/cm^2$ and a temperature of 400°-600° C. for 10-1200 seconds to obtain a treated oil, secondly the treated oil is stripped of the light fraction having a boiling point of not higher than 400° C. and thirdly the remaining oil is heat treated at a lower temperature of 300°-480° C. and a pressure of atmospheric pressure to 50 $Kg/cm^2$ for 1-10 hours thereby to obtain pitch having a remarkably high softening point of 172°-215° C.

Japanese Patent Gazette No. 30073/1968 has proposed that pitch having a high softening point may be incorporated with a low boiling oil such as a light fraction to adjust the high softening point to a desired low one; however, the presence of such a light fraction in the pitch contained in green carbon electrodes, fireproof bricks or the like will result in the rapid expansion of these shaped bodies due to the gasification of the light fraction when the shaped bodies are baked, thereby raising problems as to the changes in shape of the shaped bodies, the creation of cavities therein and the destruction thereof. Thus, the process of the Patent Gazette does not give satisfactory final shaped bodies.

Japanese Patent Application Laying-Open Gazette No. 35420/1974 discloses a process comprising heat treating a heavy fraction at 350°-470° C. under pressure and, as required, stripping the heat treated heavy fraction of the light fraction thereby to adjust the softening point of the resulting pitch to a desired one. In other words, various softening points may be obtained in the resulting pitch depending on the amount of the light fraction removed. However, the presence of the light fraction in the resulting pitch will not result in the production of satisfactory shaped bodies as previously mentioned. Pitch of practical use is one which does substantially not contain a fraction boiling at lower than 400° C. and, on the other hand, pitch prepared from a heavy fraction boiling at not lower than 400° C. will have a remarkably elevated softening point as indicated in the aforesaid Japanese Patent Application Laying-Open Gazette No. 73405/1973.

Furthermore, even when a heavy residual oil is heat treated, industrially serious troubles will be caused. For example, assuming that there is used a one-step heat treating process wherein heating tubes and soakers (thermal reforming reactors) are used in combination, there will, first of all, be caused a problem as to the deposition of carbon in the tubes, and, due to plugging thereof, the continuous operation of the process will have to be suspended. It was impossible to carry out conventional heat treating processes continuously for a long period of time due to such troubles as mentioned above. There have been proposed various processes for preventing the deposition of carbon in the heated tubes and the clogging thereof. The proposed processes include a process comprising increasing a superficial linear velocity and a process for introducing steam. However, these processes may be carried out continuously for a somewhat longer period of time, but they cannot stand their several-week continuous operation and the operation thereof has to be suspended whenever carbon deposited within the heating tubes is removed. To avoid such a disadvantage, there is now employed a process wherein two sets of heating tubes are alternately used to ensure a continuous operation although this process is an economically undesirable one. In addition, the carbon precipitation on the gas-liquid interface in the soaker is vitally defective for the conventional process. Even if steam, for example, is introduced into the soaker in attempts to prevent carbon from deposition, this will not substantially be effective for the intended purpose. If the temperature for the heat treatment is raised to increase a content of fixed carbon, carbon precipitation will be remarkable on the liquid interface thereby causing troubles, such as plugging of the outlet nozzle of the soaker, which are serious to the process.

Japanese Patent Application Laying-Open Gazette No. 22422/1972 discloses that a heavy fraction is slowly raised in temperature under an inert gas stream thereby to prevent coking otherwise caused by sudden thermal cracking and polymerization.

In addition, Japanese Patent Application Laying-Open Gazette No. 35420/1974 discloses that a conventional one-step treatment is effected at a high pressure, a low boiling fraction is incorporated in a starting oil and other techniques are used, thereby to avoid coking. Although these techniqes are somewhat effective for the avoidance of coking, it will be difficult to carry out a long-time continuous operation and, therefore, it will be impossible to carry out a continuous production of pitch.

The present inventors made intensive studies in attempts to solve the aforesaid problems as to not only processes for the continuous production of petroleum-derived pitch but also the quality of pitch to be produced and, as a result of their studies, they found that these problems arised from the same cause and were solved at the same time by the use of a novel process of this invention. This invention is based on this finding.

This invention will be detailed hereinbelow.

Figure 1:
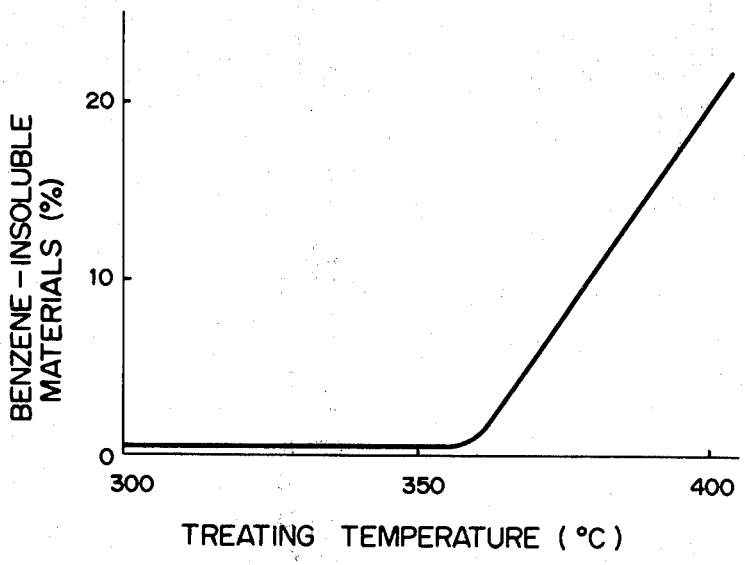
FIG. 1 is a graph showing the relationship between heat treating temperatures and the amounts of benzene-insoluble materials.
Figure 2:
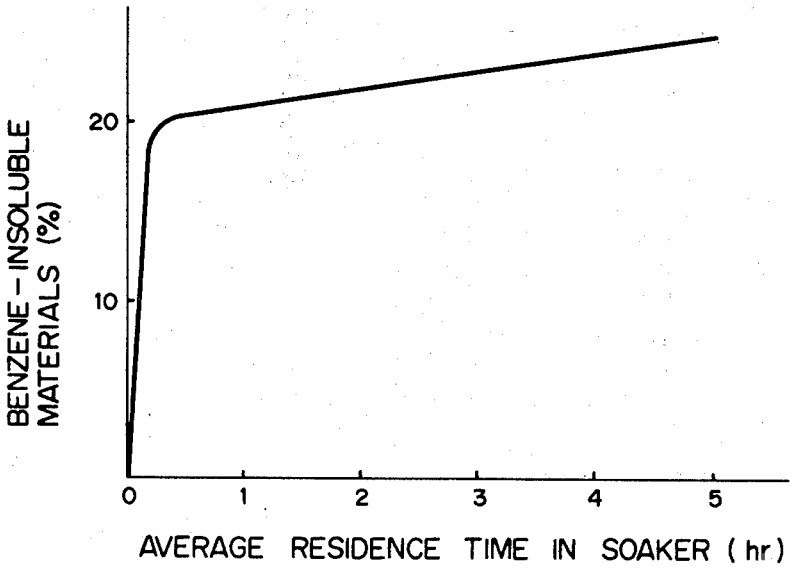
FIG. 2 is a graph showing the relationship between average residence times in a soaker and the amounts of benzene-insoluble materials.
Figure 3:
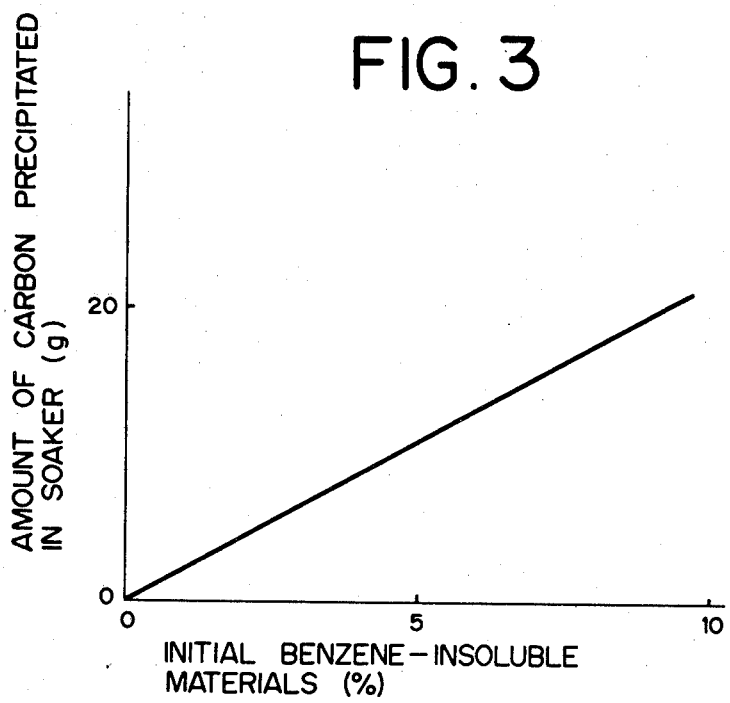
FIG. 3 is a graph showing the relationship between the initial amounts of benzene-insoluble materials and the amounts of carbon deposited in a soaker.

In a case where there is heat treated a heavy residual oil obtained as a by-product by the steam cracking of petroleum-derived hydrocarbons, benzene-insoluble materials begin to be produced in the residual oil at a heat treating temperature of about 360° C. and the amount thereof produced sharply increases with the rise of the heat treating temperature as indicated in FIG. 1. It has also been found that carbon deposition in heating tubes and carbon precipitation in a soaker start at a heat treating temperature of about 360° C. and the carbon deposition rate remarkably increases as the heat treating temperature rises. In addition, the relationship between the treating time (average residence time) and the amount of benzene-insoluble materials produced was investigated with the result that the amount of benzene-insoluble materials produced was found to sharply increase in a considerably short time after start of the heat treatment as indicated in FIG. 2. The benzene-insoluble materials so produced unusually at the initial stage of the reaction (the materials being hereinafter referred to as "initial benzene-insoluble materials") are in interrelation to the amount of carbon precipitated as shown in FIG. 3; it has been found that carbon precipitation in the soaker may be inhibited by preventing the initial benzene-insoluble materials from being produced. It is generally known that as the amount of benzene-insoluble materials produced in pitch increases, the resulting pitch will gradually be raised particularly in softening point, one of the properties of the pitch. As is clear from FIG. 2, the production of the initial benzene-insoluble materials results in an increase in total amount of benzene-insoluble materials; this leads to the production of pitch having a softening point which is so raised as to correspond to the amount increased of the total amount of benzene-insoluble materials (the amount increased being equal to the initial benzene-insoluble materials). Thus, the present inventors found that in order to produce pitch which has a high content of fixed carbon and a softening point of 60°–100° C. and is useful as a binder for carbon electrodes, fire-proof bricks and the like, from a heavy residual oil produced as a by-product at the time of steam cracking, it is necessary to inhibit the initial benzene-insoluble materials from being produced.

Figure 4:
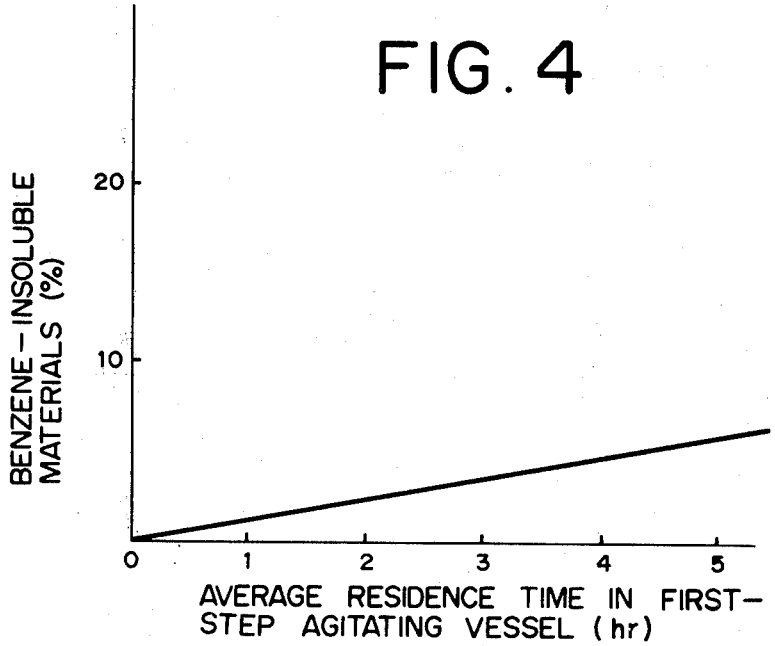
FIG. 4 is a graph showing the relationship between average residence times in a first-step agitating vessel and the amounts of benzene-insoluble materials (As is apparent from the comparison with FIG. 2, the production of benzene-insoluble materials can be inhibited.)

Bearing this in mind, the present inventors made further studies and found that the conventional problems were solved at the same time by the use of the novel process of this invention. FIG. 4 shows the relationship between the amount of benzene-insoluble materials contained in the resulting pitch produced by the process of this invention and the average residence time in the first-step agitating vessel. As is apparent from the comparison with FIG. 2, it is possible to inhibit the initial benzene-insoluble materials by the use of the process of this invention.

In addition, this invention has made it possible to carry out a long-term continuous operation for the production of pitch.

In this invention, there is used as the starting material a heavy residual oil boiling at not lower than 150° C. which is obtained as a by-product when producing olefins by thermocracking or steam cracking petroleum-derived hydrocarbons. The petroleum-derived hydrocarbons used herein may usually be light hydrocarbons such as naphtha, gas oil and kerosene, and the steam cracking may usually be effected at 600° to 1000° C. The heavy residual oils used herein include those having a boiling point of at least 150° C. as mentioned above, with those having a boiling point of at least 200° C. being particularly preferred.

The process of this invention comprises feeding the heavy residual oil continuously into a first-step agitating vessel maintained at a pressure of at least 2 Kg/cm$^2$ and a temperature of 300° to 360° C., keeping the oil therein for an average residence time of at least 15 minutes, withdrawing the first-step treated oil continuously from the first-step agitating vessel, charging the first-step treated oil into a second-step agitating vessel maintained at a temperature of 370° to 450° C., keeping the oil therein for an average residence time of 30 minutes to 10 hours, withdrawing the second-step treated oil continuously from the second-step agitating vessel and then removing from the second-step treated oil the light fraction contained therein, thereby to obtain petroleum-derived pitch continuously.

The reaction in the first-step agitating vessel according to this invention must be effected under certain strict conditions for attainment of the object of this invention. First of all, the pressure used in the first-step vessel should be at least 2 Kg/cm$^2$G (Gauge), preferably 5 to 20 Kg/cm$^2$G. It is necessary that the pressure be high enough to confine the oil vapor of the starting oil to the first-step vessel; however, higher pressures such as external pressures exerted by inert gases or the like, may also be used in this invention if required operationally.

On the other hand, the use of lower pressures, such as atmospheric pressure, than is necessary for this invention in the heat treatment will not only result in a low yield of the final product pitch but also result in causing troubles such as precipitation of carbon and production of pitch having an elevated softening point in the subsequent second step (the reason for causing such troubles being not theoretically known as yet), whereby the object of this invention is not attained. The first-step agitating vessel should be maintained in the range of from 300° to 360° C., preferably 330°–350° C. In order to attain the object of this invention, the temperature in the first-step vessel may of course be varied within said range during the operation, but it may preferably be a certain fixed one within said range if required operationally. The use of a temperature of lower than 300° C. will not exhibit the effects of this invention, while the use of a temperature of higher than 360° C. will raise problems such as carbon precipitation in the first-step agitating vessel thereby rendering it difficult to effect a continuous operation. In this invention, the starting oil should be present in the first-step agitating vessel for an average residence time of at least 15 minutes, preferably 1 to 5 hours. An average residence time of shorter than 15 minutes is not suitable for attaining the object of this invention.

The first-step treated oil from the first-step vessel in then charged into the second-step agitating vessel. The second-step vessel should be maintained in the range of from 370° to 450° C., preferably from 390° to 430° C. It is usually preferable to maintain the second-step vessel at a certain fixed temperature in order to meet the requirements for a continuous operation. The use of a temperature lower than 370° C. will not result in substantial improvement of the resulting pitch in properties, while the use of a temperature of higher than 450° C. will result in the production of coke-like material rather than pitch; the product produced in each case will be of no commercial value. The average residence time in the second-step agitating vessel may suitably be selected in view of the treating temperature in the second-step vessel and it may be usually 30 minutes to 10 hours, preferably 1 to 5 hours. The pressure used in the second-step vessel is not particularly limited, but it may be 2 to 20 $Kg/cm^2G$, preferably 5 to 15 in view of yields and problems as to operation.

The final product pitch is obtained by removing the light fraction from the second-step treated oil. The method for removal of the light fraction is not particularly limited but it usually comprises distilling off the light fraction by distillation under reduced pressure such as continuous flushing. The light fraction referred to herein is a fraction boiling at lower than about 400° C. In other words, the product pitch according to this invention preferably consists substantially of a heavy fraction boiling at not lower than 400° C. The term "substantially" used herein is intended to mean that the product pitch is allowed to contain the light fraction in such an amount that the fraction will have no adverse effects on moldings containing the pitch as the binder at the time of baking the moldings. It is preferable that the amount of the light fraction usually contained in the product pitch should be in the range of 0 to 5% by weight.

In the invention, the starting oil is usually preliminarily heated to a predetermined temperature before being charged into the first-step agitating vessel. The "predetermined temperature" referred to herein is intended to mean the temperature within the first-step agitating vessel or a temperature somewhat higher than the former. There are methods for the preliminary heating of the starting oil, such as a method comprising passing the starting oil through heating tubes to directly heating it to a predetermined temperature; a method comprising withdrawing the recycling oil, heating the recycling oil so withdrawn and then mixing the heated recycling oil with the starting oil to raise the temperature of the starting oil to a predetermined temperature; a method comprising mixing the heated recycling oil with the starting oil heated to a certain temperature by passage through the heating tubes, thereby to heat the starting oil to a predetermined temperature; and a process comprising mixing the recycling oil with the starting oil and passing the resulting mixture through the heating tubes thereby to heat the starting oil to a predetermined temperature. The starting oil may be charged into the first-step agitating vessel without the preliminary heating thereof if the vessel is provided with a heating device, or else it may be charged into the first-step agitating vessel after being preliminarily heated by any one of the aforesaid methods.

The first-step treated oil from the first-step agitating vessel is charged into the second-step agitating vessel; in this case, it is usually preliminarily heated before being charged into the second-step vessel. This preliminary heating may be effected by any one of said methods.

The time needed for heating the starting oil or the treated oil to a predetermined temperature by passing the oil through the heating tubes, is not particularly limited but may advantageously be in the range of not longer than about 5 minutes from the industrial point of view. To raise the temperature of the oil to the predetermined temperature in more than 5 minutes, longer heating tubes have to be used or the linear velocity have to be extremely retarded; these heating methods are not considered to be industrially economical ones.

By the process of this invention there may be obtained in a high yield pitch having satisfactory properties such as a fixed carbon content of usually at least 45% and a softening point of 60° to 100° C. The pitch may effectively be used as a pitch binder in the production of moldings such as carbon electrodes and fireproof bricks.

In the practice of the specified two-step treatment of this invention, no carbon precipitation takes place in the first-step and second-step agitating vessels and no carbon deposition takes place in the heating tubes when the starting oil is preliminarily heated, thereby making it possible to produce pitch continuously while keeping this heat treating system in good operational condition. Thus, the process of this invention is clearly differentiated from the conventional ones.

The agitating vessels used herein are those which have a desired inner volume and permit material therein to be kept in perfectly agitated state. They are a tank-type vessel usually provided with agitating vanes. As such vessels, steel-made drums fitted with agitating vanes are generally used.

In a process for heat treatment using such agitating vessels, a homogeneous mixture of reactants may be obtained, an average residence time may suitably be selected and a long average residence time may also be adopted, temperature control may be easily effected, a heat treating temperature may be maintained at a fixed level and a stable operation may be performed. Thus, such a process enables the reaction to be completed very stably and simultaneously yields products of uniform quality in a satisfactorily reproducible manner and in a good yield; the process is very advantageous in the aforesaid respects as compared with a process using tubular reactors. However, when the process using the agitating vessels is employed in the heat treatment of a heavy fraction, it will sometimes exhibits disadvantages that agitation is made impossible due to coking in the vessels and the plugging of the heater tubes consequently caused. This is the case with Reference examples 1 and 6 to be described later.

On the other hand, as previously mentioned, according to this invention, the use of the first-step and second-step agitating vessels for the heat treatment under the predetermined conditions will exhibit advantages while eliminating said disadvantages.

When the specified two-step heat treatment of this invention is carried out, carbon will not deposit in the heating tubes nor will carbon precipitate in the agitating vessels, which fact is quite unexpected from the conventional processes. The reason why carbon does not deposit nor does it precipitate is not quite clear but would be as follows.

In the practice of the conventional processes, certain components contained in the starting material are considered to be converted to initial benzene-insoluble materials or deposited carbon; on the other hand, in the practice of the process of this invention, it is considered that said certain components are converted to stable materials by reactions such as isomerization in the first-step treatment (in the first-step agitating vessel) and the stable materials so produced are still maintained stable in the second-step treatment thereby inhibiting carbon formation. It may be considered that a residence time of at least 15 minutes in the first-step treatment is needed for the conversion of the aforesaid certain components to the stable materials.

Figure 5:
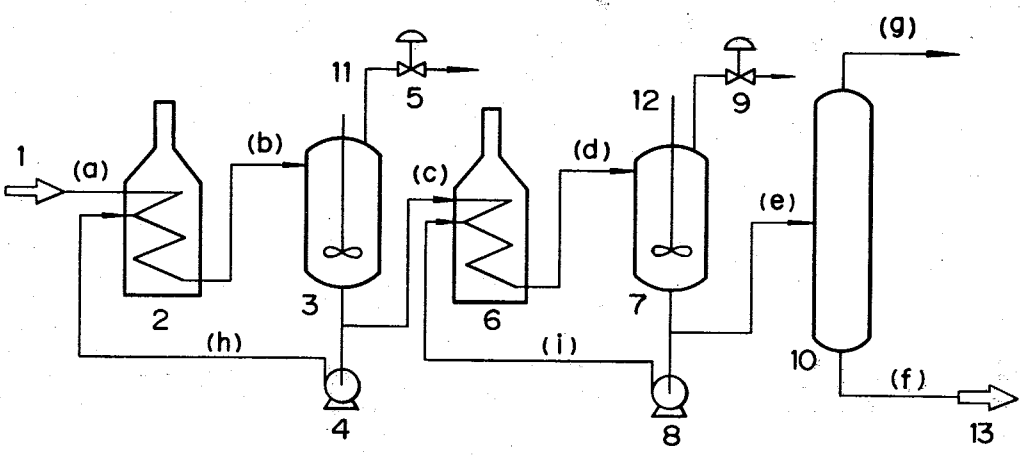
FIG. 5 is a diagrammatic view of an exemplary apparatus for carrying out the process of this invention.

Referring now to FIG. 5 which shows a diagrammatic view of an exemplary apparatus for carrying out the process of this invention, a starting oil 1 is passed through a line (a) to a first heater 2 where the oil 1 is heated to a predetermined temperature. The oil 1 so heated is passed to a first-step agitating vessel 3 wherein perfect mixing of the oil 1 is attained by a first agitating vane 11. The first-step agitating vessel 3 is maintained at a fixed pressure by the use of a pressure control valve 5. In addition, a part of the oil treated in the first-step agitating vessel is circulated, by a first circulating pump 4, through a line (h) to the first heater 2 where it is mixed with an incoming starting oil. A first-step treated oil continuously withdrawn from the first-step agitating vessel is passed through a line (c) to a second heater 6 where it is heated to a predetermined temperature. The oil so heated in the second heater 6 is charged into a second-step agitating vessel 7 where perfect mixing of the oil is attained by a second agitating vane 12. The second-step agitating vessel is maintained at a fixed pressure by a pressure control valve 9. In addition, a part of the second-step treated oil is circulated, by a second circulating pump 8, through a line (i) to the second heater where it is mixed with the first-step treated oil.

The second-step treated oil continuously withdrawn from the second-step agitating vessel is passed through a line (e) to a reduced-pressure flush tower 10 from which product pitch is obtained through a line (f).

This invention will be better understood by the following non-limitative Examples.

EXAMPLES 1-2

There was provided a heavy residual oil produced as a by-product at the time of the steam cracking of naphtha. The heavy residual oil so provided had the properties shown in the following Table 1. The heavy residual oil which was the starting oil, was passed through a pipe still having 4-mm inner diameter pipes to be heated to a predetermined temperature, after which the oil so heated was charged continuously into a first-step agitating vessel where perfect mixing of the oil is attained, for heat treatment. The agitating vessel was maintained at a pressure of 15 Kg/cm$^2$G and an average residence time of the oil therein was one hour.

The heat treated oil withdrawn continuously from the first-step agitating vessel was passed through a second pipe still where it was further heated to a predetermined temperature, after which it was introduced into a 2-liter second-step agitating vessel where it was heat treated at a pressure of 10 Kg/cm$^2$G for an average residence time of one hour. Then, the finally heat treated material withdrawn continuously from the second-step agitating vessel was introduced into a flash distillation tower operated at 250° C. and 10 mmHg to distill off the light fraction boiling at lower than 400° C. while withdrawing produced pitch from the tower at the bottom. Table 2 shows the treating conditions in the first-step and second-step treatments, the properties of the pitch so produced, and the like. In each Example, the operation was continued for 7 hours after the operational temperature had attained to the stationary state.

COMPARATIVE EXAMPLES 1-2

A conventional one-step heat treating process was carried out for comparison with the process of this invention.

The same starting oil as used in Example 1 was passed through a pipe still having 4-mm inner diameter pipes to heat the oil to a predetermined temperature, after which the thus-heated oil was continuously charged into a soaker where it was treated at 10 Kg/cm$^2$G for one hour. The oil so treated was then introduced into a flash distillation tower where it was treated in the same manner as in Example 1 thereby to obtain pitch. The results are also shown in Table 2. The operation was continued for the same 7 hours as in Example 1.

COMPARATIVE EXAMPLE 3

The procedure of Example 1 was followed except that the first-step agitating vessel was maintained at 250° C., thereby to obtain pitch. The results are shown in Table 2.

EXAMPLE 3

The procedure of Example 1 was followed except that the first-step agitating vessel was maintained at 350° C. and 10 Kg/cm$^2$G, the average residence time of the starting oil in the first-step vessel two hours, the second-step agitating vessel maintained at 400° C. and 8 Kg/cm$^2$G and the average residence time of the oil in the second-step vessel one hour. The results are indicated in Table 3. The operation was continued for 40 hours.

COMPARATIVE EXAMPLE 4

The procedure of Example 3 was followed except that the first-step treatment was effected at atmospheric pressure. The results are shown in Table 3.

Table 1

| Properties of starting oil | |
|---|---|
| Specific gravity (15° C./4° C.) | 1.047 |
| Fixed carbon (%) | 4.2 |
| Initial b.p. | 156 (°C.) |
| 5% | 179 |
| 10% | 195 |

Table 1-continued

| Properties of starting oil | | |
|---|---|---|
| Specific gravity (15° C./4° C.) | | 1.047 |
| Fixed carbon (%) | | 4.2 |
| Distillation analysis | 20% | 208 |
| | 30% | 218 |
| | 30% | 218 |
| | 40% | 235 |
| | 50% | 269 |
| | 60% | 312 |
| | 70% | 346 |

thereby to obtain pitch. The operation was continued for 48 hours. The results are shown in Table 4.

EXAMPLE 5

The procedure of Example 4 was followed except that the average residence time in the first-step treatment was 15 minutes and the operation of the apparatus continued for 28 hours, thereby to obtain pitch. The results are shown in Table 4.

COMPARATIVE EXAMPLE 5

The procedure of Example 4 was followed except that the average residence time in the first-step treatment was two minutes and the operation of the apparatus continued for 10 hours. In this case, in the first-step treatment a pipe still adjusted to 350° C. was employed in substitution for the perfect mixing type agitating vessel as used in Example 6. The results as well as those of Examples 4 and 5 are indicated in Table 4.

Table 2

| | First-step treating conditions | | | Second-step treating conditions | | | Properties of pitch obtained | | | | | After stoppage of operation | |
|---|---|---|---|---|---|---|---|---|---|---|---|---|---|
| | Temp. (°C.) | Pressure (Kg/cm²G) | Average residence time (hr) | Temp. (°C.) | Pressure (Kg/cm²G) | Average residence time (hr) | Initial benzene-insoluble materials (%) | Benzene insoluble materials (%) | Fixed carbon (%) | Softening point (°C.) | Yield of pitch (%) | Amount of carbon deposited in soaker (g) | state of carbon precipitated in pipe still |
| Example 1 | 300 | 15 | 1 | 400 | 10 | 1 | 2.0 | 10.5 | 48 | 70 | 46 | 3.0 | Slight coking |
| Example 2 | 350 | 15 | 1 | 400 | 10 | 1 | Trace | 6.5 | 53 | 62 | 48 | Trace | Trace |
| Comparative example 1 | — | — | — | 400 | 10 | 1 | 9 | 18 | 51 | 121 | 35 | 21.2 | Stoppage due to clogging |
| Comparative example 2 | — | — | — | 340 | 10 | 1 | 0 | 0 | 28 | 45 | 50 | 0 | No coking |
| Comparative example 3 | 250 | 15 | 1 | 400 | 10 | 1 | 7 | 13 | 44 | 72 | 38 | 15.2 | Almost clogged |

Table 3

| | First-step treating Conditions | | | Second-step treating Conditions | | | Properties of pitch obtained | | | | | After stoppage of operation | |
|---|---|---|---|---|---|---|---|---|---|---|---|---|---|
| | Temp. (°C.) | Pressure (kq/. cm²G) | Average residence time (hr) | Temp. (°C.) | Pressure (Kg/cm²G) | Average residence time (hr) | Initial benzene-insoluble materials (%) | Benzene insoluble materials (%) | Fixed carbon (%) | Softening point (°C.) | Yield of pitch (%) | Amount of carbon deposited in soaker (g) | State of carbon precipitated in pipe still |
| Example 1 | 350 | 10 | 2 | 400 | 8 | 1 | Trace | 12 | 54 | 89 | 48 | Trace | Trace |
| Comparative example 4 | 350 | 0 | 2 | 400 | 8 | 1 | 7.5 | 19.5 | 50 | 109 | 38 | 25 | Remarkable coking |

EXAMPLE 4

The procedure of Example 1 was followed except that the first-step treatment was effected at 350° C. and 20 Kg/cm²G, the average residence time three hours, the second-step treatment effected at 400° C. and 15 Kg/cm²G, and the average residence time 1.5 hours, Table 4

| | First-step treating conditions | | | Second-step treating conditions | | | Properties of pitch obtained | | | | | After stoppage of operation | |
|---|---|---|---|---|---|---|---|---|---|---|---|---|---|
| | Temp. (°C.) | Pressure (Kg/cm²G) | Average residence time (min) | Temp. (°C.) | Pressure (Kg/cm²G) | Average residence time (min) | Initial benzene-insoluble materials (%) | Benzene-insoluble materials (%) | Fixed carbon (%) | Softening point (°C.) | Yield of pitch (%) | Amount of carbon deposited in soaker | State of carbon precipitated in pipe still |
| Example 4 | 350 | 20 | 180 | 400 | 15 | 90 | 0 | 7 | 55 | 75 | 50 | Small amount | No coking |
| Example 5 | 350 | 20 | 15 | 400 | 15 | 90 | 3 | 10 | 50 | 80 | 46 | Small amount | Almost plugged |
| Comparative | 350 | 20 | 2 | 400 | 15 | 90 | 39 | 27 | 45 | 118 | 39 | Large amount | Plugged |

Table 4-continued

| | First-step treating conditions | | | Second-step treating conditions | | | Properties of pitch obtained | | | | | After stoppage of operation | |
|---|---|---|---|---|---|---|---|---|---|---|---|---|---|
| | Temp. (°C.) | Pressure (Kg/cm²G) | Average residence time (min) | Temp. (°C.) | Pressure (Kg/cm²G) | Average residence time (min) | Initial benzene-insoluble materials (%) | Benzene-insoluble materials (%) | Fixed carbon (%) | Softening point (°C.) | Yield of pitch (%) | Amount of carbon deposited in soaker | State of carbon precipitated in pipe still |
| example 5 | | | | | | | | | | | | | |

EXAMPLE 6

The same starting oil as used in Example 1 was heat treated by the use of a reforming apparatus as shown in FIG. 5. The starting oil was passed at a flow rate of 100 l/hr through a line (a) to a first heater (having 21.7-mm diameter heating pipes) 2 to heat the oil to 360° C., after which the heated oil was continuously charged into a 300-liter first-step agitating vessel 3 wherein the agitator agitated the oil under conditions that no reactants may be stagnated. The oil so charged was heat treated for an average residence time of 3 hours in the first-step agitating vessel 3 maintained at 355° C. and 14 Kg/cm²G (adjusted by a pressure control valve 5). The flow rate of the oil in the first heating pipes was maintained at 2 m/sec by circulating the oil via a line (h) between the first-step agitating vessel and the first heater by the use of a first circulating pump 4.

The first-step treated oil withdrawn continuously from the first-step agitating vessel was passed through a line (c) to a second heater 6 where it was heated to 415° C. The oil so heated was charged continuously into a 150-liter second-step agitating vessel maintained at 410° C. and 12 Kg/cm²G by a pressure control valve 9. The agitating conditions were the same as in the first-step agitating vessel. The flow rate of the oil in the second heating pipes was maintained at 2 m/sec. by circulating the oil via a line (i) between the second-step agitating vessel and the second heater by the use of a second circulating pump 8. The second-step treated oil withdrawn continuously from the second-step agitating vessel after the end of an average residence time of 3 hours therein, was passed through a line (e) to a reduced-pressure flush tower 10 maintained at a pressure of 60 mm Hg, thereby to continuously distil off a light oil fraction boiling at substantially lower than 400° C. and obtain pitch as the product. The results are indicated in Table 5.

COMPARATIVE EXAMPLE 6

Referring to FIG. 5, the starting oil was passed through the line (c) to the second heater where it was heated to 415° C. The oil so heated was then heat treated in the second-step agitating vessel maintained under the same conditions as in Example 6, thus obtaining pitch as the product in the same manner as in Example 6. The results are indicated in Table 5.

Table 5

| | Yield of pitch (%) | Properties of pitch obtained: Benzene-insoluble materials (%) | Fixed carbon (%) | Softening point (°C.) | State of continuous operation |
|---|---|---|---|---|---|
| Example 6 | 49 | 26 | 56 | 90 | Carbon deposited in a small amount in second heater even after 14 days' continuous operation. |
| Comparative example 6 | 37 | 38 | 50 | 125 | Second heater clogged with carbon deposited only after 13 hours' operation. |

EXAMPLE 7

Electrode pieces were prepared using, as the binder, the product pitch obtained in each of Example 6 and Comparative example 6 as well as coal-tar pitch (benzene-insoluble materials 37%, fixed carbon 53%, softening point 84° C.) for comparison. More particularly, No. 2 calcined petroleum coke (regular coke) was pulverized and classified, according to particle size, into coarse particles (greater than 10 mesh), medium particles (10 to 100 mesh) and fine particles (finer than 100 mesh). One hundred parts by weight of coke consisting of 18 wt.% of the coarse particles, 46 wt.% of the medium particles and 36 wt.% of the fine particles, were incorporated with 20 parts by weight of each of the aforesaid pitch binders. The resulting mixtures were kneaded under heat and then formed into electrode pieces having a size of 50 cm Φ × 100 cm. The electrode pieces so obtained were each bud in coke powder (breeze) and then baked at a temperature-raising rate of 10° C./ hr to 1200° C. in an electric furnace thereby to obtain test pieces. By using the thus-obtained test pieces as carbon electrodes for refining aluminum, they were measured for electrode characteristics. The results are indicated in Table 6.

Table 6

| | | Pitch obtained in Example 6 | Pitch obtained in Comparative example 6 | Coal-tar pitch |
|---|---|---|---|---|
| Amount of breeze attached | Kg/cm² | 0.001 | 0.087 | 0.021 |
| Voluminal shrinkage | % | 1.79 | 1.68 | 1.81 |

Table 6-continued

| | | Pitch obtained in Example 6 | Pitch obtained in Comparative example 6 | Coal-tar pitch |
|---|---|---|---|---|
| Characteristics of baked electrode | | | | |
| Bulk density | $g/cm^3$ | 1.528 | 1.456 | 1.525 |
| Specific electric resistance | $\Omega \cdot cm \times 10^{-4}$ | 59.6 | 70.6 | 58.0 |
| Pressure resistance | $Kg/cm^2$ | 335 | 221 | 305 |
| Static modulus of elasticity | $Kg/cm^2$ | 397 | 322 | 391 |
| Amount of $CO_2$ consumed by reaction | % | 106 | 109 | 114 |
| Amount of melted salt consumed by electrolysis | % | 111 | 112 | 112 |

What is claimed is:

1. A process for the continuous production of petroleum-derived pitch consisting essentially of:

providing as the starting oil a heavy fraction boiling above 150° C., the heavy fraction being obtained by the steam cracking or thermocracking of petroleum-derived hydrocarbons.

feeding said heavy fraction continuously into a first-step agitating vessel maintained at a pressure of at least 2 $Kg/cm^2$ and a temperature of from 300° to 360° C., where the heavy fraction is heat treated for an average residence time of 15 minutes up to 5 hours, withdrawing the first-step treated fraction continuously from the first-step agitating vessel, feeding the thus-withdrawn first-step treated fraction continuously into a second-step agitating vessel maintained at a temperature of from 370° to 450° C., where the first-step treated fraction is heat treated for an average residence time of from 30 minutes to 10 hours, withdrawing the second-step treated fraction continuously from the second-step agitating vessel and removing the light fraction of boiling point below 400° C. from the second-step treated fraction, thereby to obtain the petroleum-derived pitch.

2. The process according to claim 1 wherein the pressure in the second step agitating vessel is 2–20 $kg/cm^2$.

3. Petroleum-derived pitch obtained by the process of claim 1.

* * * * *